US012187328B2

(12) United States Patent
Zhu et al.

(10) Patent No.: US 12,187,328 B2
(45) Date of Patent: Jan. 7, 2025

(54) GUIDE-TYPE ANTI-CLIMBING ENERGY-ABSORBING DEVICE BASED ON HYDRAULIC SHEARING

(71) Applicant: Southwest Jiaotong University, Chengdu (CN)

(72) Inventors: Tao Zhu, Chengdu (CN); Jingke Zhang, Chengdu (CN); Shoune Xiao, Chengdu (CN); Guangwu Yang, Chengdu (CN); Bing Yang, Chengdu (CN); Mingmeng Wang, Chengdu (CN); Dongdong Chen, Chengdu (CN)

(73) Assignee: Southwest Jiaotong University, Chengdu (CN)

( * ) Notice: Subject to any disclaimer, the term of this patent is extended or adjusted under 35 U.S.C. 154(b) by 0 days.

(21) Appl. No.: 18/759,788

(22) Filed: Jun. 28, 2024

(65) Prior Publication Data

US 2024/0351621 A1 Oct. 24, 2024

Related U.S. Application Data

(63) Continuation of application No. PCT/CN2024/093602, filed on May 16, 2024.

(30) Foreign Application Priority Data

Aug. 11, 2023 (CN) ..... 202311008757.0

(51) Int. Cl.
*B61G 11/12* (2006.01)

(52) U.S. Cl.
CPC ..... *B61G 11/12* (2013.01)

(58) Field of Classification Search
CPC ..... B61G 11/12
See application file for complete search history.

(56) References Cited

U.S. PATENT DOCUMENTS 6,685,243 B1 2/2004 Evans
2003/0070895 A1 4/2003 Reid
(Continued)

FOREIGN PATENT DOCUMENTS

CN 101801757 A 8/2010
CN 103625553 A 3/2014
(Continued)

OTHER PUBLICATIONS

Cheng Lei et al., "New Special Energy-Absorbing Component at Vehicle End of Rail Vehicles", Journal of Southwest Jiaotong University, vol. 48, No. 4, Aug. 15, 2013, pp. 738-744.
(Continued)

*Primary Examiner* — Robert J McCarry, Jr.

(57) ABSTRACT

A guide-type anti-climbing energy-absorbing device based on hydraulic shearing includes an energy-absorbing tube, an anti-climbing portion, a first connecting portion, a plurality of partition plates, and two guide plates. The anti-climbing portion and the first connecting portion are respectively provided at two ends of the energy-absorbing tube. The partition plates are sequentially arranged inside the energy-absorbing tube along an axial direction to divide the interior of the energy-absorbing tube into a plurality of first energy-absorbing cavities, each filled with a first honeycomb body. The two guide plates are symmetrically arranged in the energy-absorbing tube along a vertical direction of the energy-absorbing tube. Each guide plate is arranged obliquely and includes a connecting end connected to the anti-climbing portion and a free end passing through the partition plates in sequence to extend outside the first connecting portion.

8 Claims, 5 Drawing Sheets

(56) References Cited

U.S. PATENT DOCUMENTS

| | | | | |
|---|---|---|---|---|
| 2016/0347333 | A1 | 12/2016 | Lenzi et al. | |
| 2019/0077420 | A1* | 3/2019 | Debost | B61D 15/06 |

FOREIGN PATENT DOCUMENTS

| | | | | | |
|---|---|---|---|---|---|
| CN | 103786741 | A | | 5/2014 | |
| CN | 105966417 | A | | 9/2016 | |
| CN | 106364520 | A | | 2/2017 | |
| CN | 206708280 | U | | 12/2017 | |
| CN | 107901941 | A | | 4/2018 | |
| CN | 108032827 | A | | 5/2018 | |
| CN | 207374492 | U | | 5/2018 | |
| CN | 108163004 | A | | 6/2018 | |
| CN | 108909765 | A | | 11/2018 | |
| CN | 109050569 | A | * | 12/2018 | B61G 11/12 |
| CN | 112158159 | A | | 1/2021 | |
| CN | 112977524 | A | | 6/2021 | |
| CN | 213413786 | U | | 6/2021 | |
| CN | 113635932 | A | | 11/2021 | |
| DE | 10257853 | A1 | | 7/2004 | |
| DE | 102018101043 | A1 | | 2/2019 | |
| DE | 102019104731 | A1 | | 8/2019 | |
| EP | 1746007 | A2 | | 1/2007 | |
| EP | 2085285 | A1 | | 8/2009 | |
| IT | TO20070443 | A1 | | 12/2008 | |
| WO | 2021120081 | A1 | | 6/2021 | |

OTHER PUBLICATIONS

Chengbiao Yuan et al., "Study on Collision Properties of Anti-climbing Energy Absorption Device for Low-floor Vehicles", Electric Drive for Locomotives, No. 5, Sep. 10, 2018, pp. 83-88.

Zhen Wang et al., "Axial energy absorption characteristics of unidirectional carbon-fiber composite cone tubes", Journal of Vibration and Shock, vol. 37, No. 7, Apr. 15, 2018, pp. 172-178.

* cited by examiner

GUIDE-TYPE ANTI-CLIMBING ENERGY-ABSORBING DEVICE BASED ON HYDRAULIC SHEARING

CROSS-REFERENCE TO RELATED APPLICATIONS

This application is a continuation of International Patent Application No. PCT/CN2024/093602, filed on May 16, 2024, which claims the benefit of priority from Chinese Patent Application No. 202311008757.0, filed on Aug. 11, 2023. The content of the aforementioned application, including any intervening amendments made thereto, is incorporated herein by reference in its entirety.

TECHNICAL FIELD

This application relates to anti-climbing devices, and more particularly to a guide-type anti-climbing energy-absorbing device based on hydraulic shearing.

BACKGROUND

Anti-climbing devices have been extensively used in rail transit to prevent trains from overlapping each other and play a buffering and energy-absorbing role in the event of a crash. In the case of a collision, the anti-climbing device can provide a larger living space for crew and passengers and greatly reduce the damage caused by the collision by the excellent buffering and energy absorption capacity.

In terms of the acting mechanism, the existing anti-climbing devices are mainly classified into cutting-type anti-climbing devices, crushing-type anti-climbing devices, and expansion-type anti-climbing devices. The crushing-type anti-climbing device is provided with an energy-absorbing tube (commonly a thin-walled metal tube) filled with a honeycomb body, such that in the case of a train collision, the energy-absorbing tube and the honeycomb body are crushed and deformed to absorb the collision energy.

The existing crushing-type anti-climbing device has a simple structure and low-cost advantages. However, most of them are merely provided with the honeycomb-filled energy-absorbing tube without other additional structures, such that in the case of a collision, it is impossible to ensure that the energy-absorbing tube and the honeycomb body bear orderly and controllable plastic deformation along the longitudinal impact direction. Moreover, the entire structure tends to have a poor bearing capacity in both the vertical and the transverse directions.

SUMMARY

An object of the disclosure is to provide a guide-type anti-climbing energy-absorbing device based on hydraulic shearing to at least overcome the technical problems in the prior art that it fails to ensure the orderly and controllable plastic deformation of an energy-absorbing tube and a honeycomb body along a longitudinal impact direction, and it fails to offer a desired bearing capacity in both a vertical direction and a transverse direction.

In order to achieve the above object, the following technical solutions are adopted.

This application provides a guide-type anti-climbing energy-absorbing device based on hydraulic shearing, comprising:

an energy-absorbing tube;

an anti-climbing portion;

a first connecting portion;

a plurality of partition plates; and two guide plates;

wherein the anti-climbing portion is arranged at a first end of the energy-absorbing tube, and the first connecting portion is arranged at a second end of the energy-absorbing tube;

the plurality of partition plates are sequentially arranged inside the energy-absorbing tube along an axial direction of the energy-absorbing tube and are configured to divide an interior of the energy-absorbing tube into a plurality of first energy-absorbing cavities; and the plurality of first energy-absorbing cavities are each filled with a first honeycomb body;

the two guide plates are symmetrically arranged in the energy-absorbing tube along a vertical direction of the energy-absorbing tube; and each of the two guide plates is arranged obliquely and has a connecting end and a free end opposite to each other; the connecting end is connected to the anti-climbing portion; the free end passes through the plurality of partition plates in sequence to extend outside the first connecting portion; each of the two guide plates is in slidable fit with the first connecting portion; and the connecting end is closer to an axis of the energy-absorbing tube relative to the free end.

In some embodiments, the first honeycomb bodies filled in the plurality of energy-absorbing cavities are arranged in an ascending order in terms of yield strength along a direction from the anti-climbing portion to the first connecting portion.

In some embodiments, the guide-type anti-climbing energy-absorbing device further comprises:

a crushing tube;

wherein the crushing tube is arranged inside the energy-absorbing tube and between the two guide plates; and an axis of the crushing tube is coincident with the axis of the energy-absorbing tube; and a first end of the crushing tube is connected to the anti-climbing portion; a second end of the crushing tube passes through the plurality of partition plates in sequence to be connected to the first connecting portion; and a second energy-absorbing cavity is provided inside the crushing tube, and is filled with a second honeycomb body.

In some embodiments, the guide-type anti-climbing energy-absorbing device further comprises:

a second connecting portion; and a hydraulic energy-absorbing assembly;

wherein the second connecting portion is arranged opposite to the first connecting portion; and the hydraulic energy-absorbing assembly is arranged between the first connecting portion and the second connecting portion;

the hydraulic energy-absorbing assembly comprises a cylinder, a solenoid valve, a piston, and a piston rod; a first end of the cylinder is connected to the second connecting portion; and a second end of the cylinder faces toward the first connecting portion;

the first end of the cylinder is provided with an oil outlet; and the solenoid valve is arranged at the oil outlet, and is configured to control opening or closing of the oil outlet;

the piston is arranged inside the cylinder; a sealing cavity is provided between the piston and the oil outlet; and the sealing cavity is filled with hydraulic oil, and is communicated with the oil outlet; and a first end of the piston rod is connected to a side of the piston away from the oil outlet; and a second end of the piston rod passes through the cylinder to extend into the crushing tube, and is in contact with the second honeycomb body.

In some embodiments, an outer diameter of the cylinder is equal to an inner diameter of the crushing tube; and the second end of the cylinder passes through the first connecting portion to extend into the crushing tube; and a buffer block is provided at a side of the second connecting portion facing toward the first connecting portion; and the buffer block is arranged around the cylinder.

In some embodiments, the second honeycomb body is arranged in plurality, and a plurality of second honeycomb bodies are sequentially stacked along an axial direction of the crushing tube; and a gap is provided between one of the plurality of second honeycomb bodies close to the anti-climbing portion and the anti-climbing portion.

In some embodiments, the plurality of second honeycomb bodies are arranged in an ascending order in terms of yield strength along a direction from the anti-climbing portion to the first connecting portion.

In some embodiments, the first connecting portion is provided with a first mounting hole, and the second connecting portion is provided with a second mounting hole.

In some embodiments, at least two sides of each of the plurality of partition plates are each provided with a protrusion, and a side wall of the energy-absorbing tube is provided with a plurality of accommodating grooves in one-to-one correspondence with protrusions on the plurality of partition plates.

The present disclosure has the following beneficial effects compared to the prior art.

(1) For the anti-climbing energy-absorbing device provided herein, a plurality of partition plates are arranged inside the energy-absorbing tube to divide an interior of the energy-absorbing tube into multiple first energy-absorbing cavities, and the first energy-absorbing cavities are respectively filled with first honeycomb bodies whose yield strengths are ascending to realize the series combination of the first honeycomb bodies, thereby greatly improving the energy absorption capacity. In addition, the first honeycomb bodies can be crushed and deformed independently, which effectively prevents the mutual embedding between first honeycomb bodies in different first energy-absorbing cavities or the simultaneous deformation to enhance the energy absorption effect and make the crushing deformation process of the first honeycomb bodies more stable and orderly.

(2) The two guide plates are arranged obliquely inside the energy-absorbing tube. On the one hand, the two guide plates can play an excellent limiting and guiding role, such that the first honeycomb bodies can undergo an orderly and controllable plastic deformation along the longitudinal impact direction. Moreover, the two guide plates can further divide each of the first honeycomb bodies into structures with a trapezoidal cross-section, such that the first honeycomb body in each of the plurality of first energy-absorbing cavities can be fully crushed and deformed, thereby maximizing the energy absorption capacity. On the other hand, by means of the two guide plates, the vertical and transverse bearing capacity of the anti-climbing energy-absorbing device can be effectively improved to further improve the reliability of the anti-climbing energy-absorbing device when mounted on the train.

(3) The crushing tube filled with the second honeycomb body is arranged inside the energy-absorbing tube, which can cooperate with the first honeycomb bodies to jointly absorb the collision energy. On this basis, the hydraulic energy-absorbing assembly can utilize the viscous damping characteristic of the hydraulic oil to convert the collision energy into the pressure and heat energy of the hydraulic oil, such that the anti-climbing energy-absorbing device has a hybrid energy-absorbing capability to further improve the energy-absorbing capacity.

Figure 1:
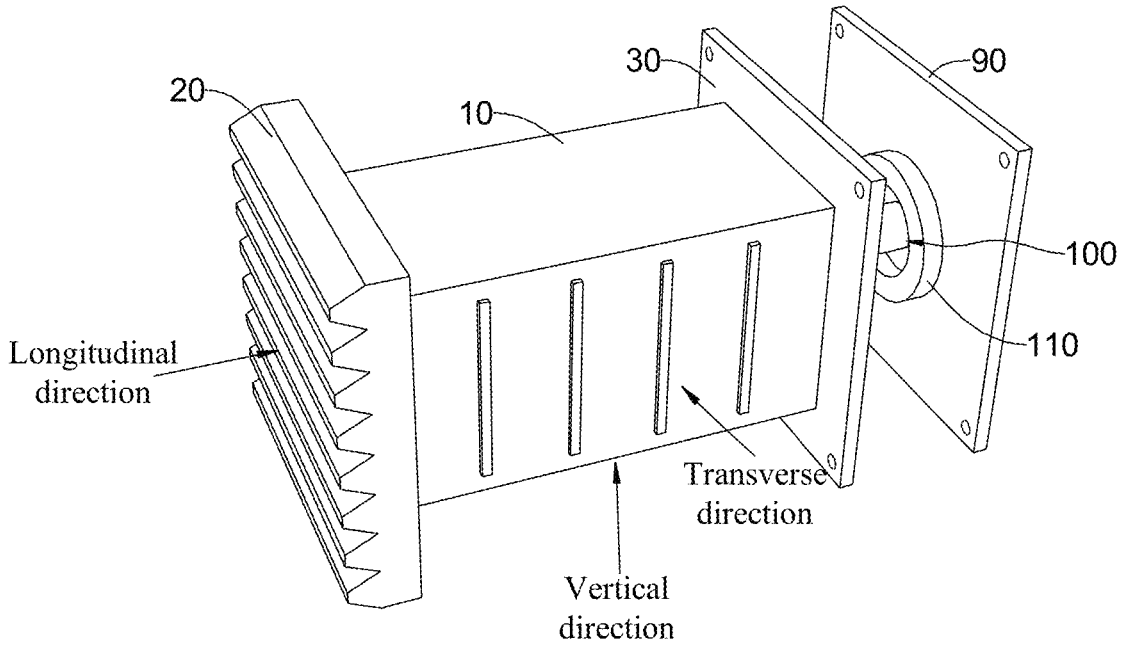
FIG. 1 is a schematic structural diagram of a guide-type anti-climbing energy-absorbing device based on hydraulic shearing in accordance with an embodiment of the present disclosure.

In the drawings: 10—energy-absorbing tube; 11—first energy-absorbing cavity; 12—accommodating groove; 20—anti-climbing portion; 30—first connecting portion; 40—partition plate; 41—protrusion; 50—guide plate; 51—connecting end; 52—free end; 60—first honeycomb body; 70—crushing tube; 71—second energy-absorbing cavity; 80—second honeycomb body; 90—second connecting portion; 100—hydraulic energy-absorbing assembly; 101—cylinder; 102—solenoid valve; 103—piston; 104—piston rod; 105—oil outlet; 106—sealing cavity; 110—buffer block; 200—train chassis; 210—first mounting base; 220—second mounting base; 230—shear bolt; and 240—fastening bolt.

DETAILED DESCRIPTION OF EMBODIMENTS

Referring to FIGS. 1-5, a guide-type anti-climbing energy-absorbing device based on hydraulic shearing is provided to at least overcome the technical problems in the prior art that it fails to ensure the orderly and controllable plastic deformation of an energy-absorbing tube 10 and a honeycomb body along a longitudinal impact direction, and it fails to offer a desired bearing capacity in both a vertical direction and a transverse direction. It should be noted that the "longitudinal direction", "vertical direction", and "transverse direction" mentioned in this embodiment can be referred to directions indicated by the arrows in FIG. 1, and will not be elaborated herein.

Specifically, the anti-climbing energy-absorbing device includes the energy-absorbing tube 10, an anti-climbing portion 20, a first connecting portion 30, a plurality of partition plates 40, and two guide plates 50.

Figure 2:
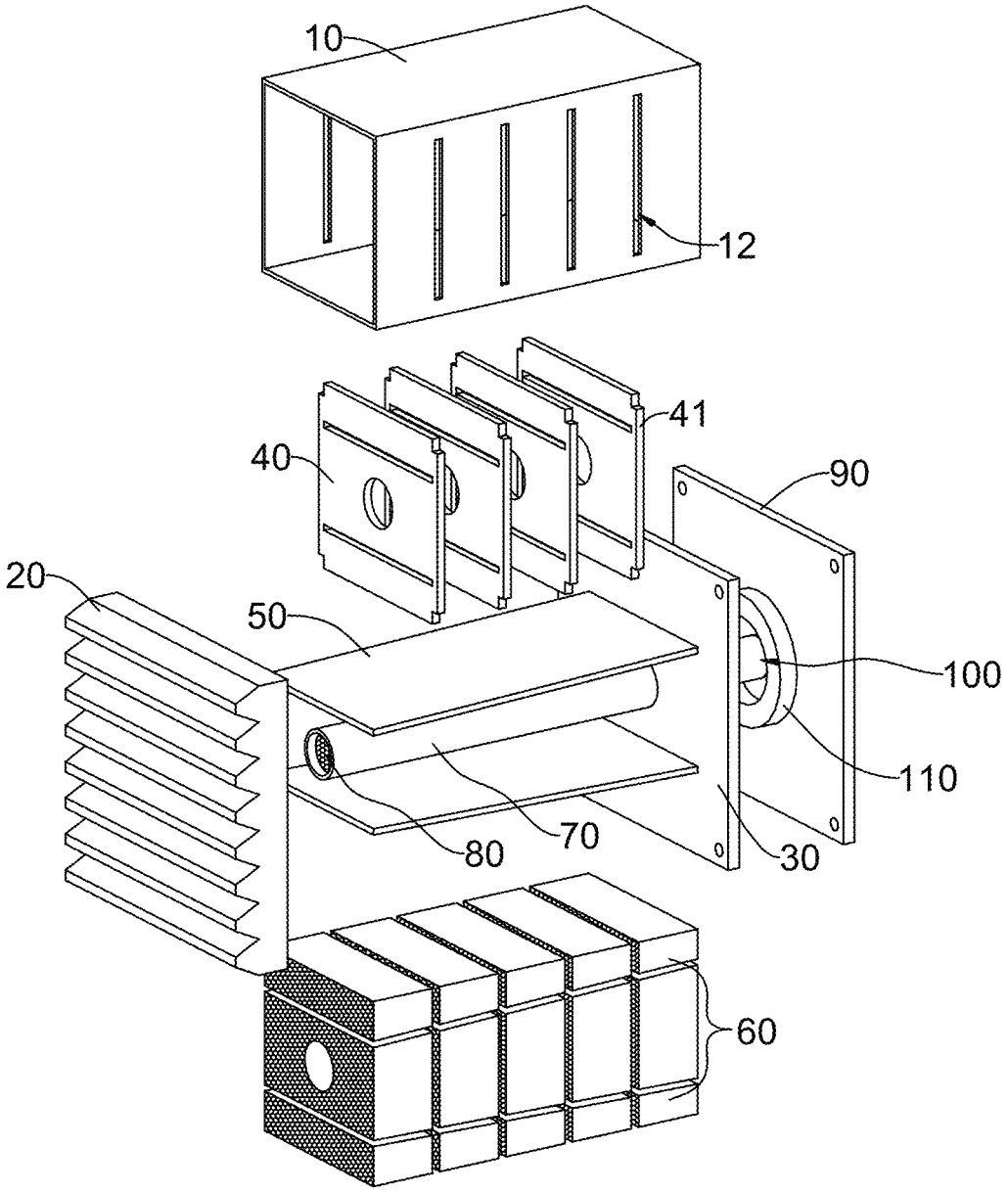
FIG. 2 is an exploded view of the guide-type anti-climbing energy-absorbing device shown in FIG. 1.

In this embodiment, as shown in FIGS. 1-2, the energy-absorbing tube 10 is a conventional thin-walled metal tube. A cross-section of the energy-absorbing tube 10 can be, but is not limited to, in a rectangular shape, that is, the energy-absorbing tube 10 can be a thin-walled metal square tube. In this case, the anti-climbing portion 20 is arranged at the first end of the energy-absorbing tube 10 and is configured for realizing the anti-climbing function. Specifically, one side of the anti-climbing portion 20 away from the energy-absorbing tube 10 is provided with anti-climbing teeth. In the practical application, when a collision occurs between two trains, anti-climbing portions 20 on the two trains can engage with each other by means of the anti-climbing teeth, thereby realizing the anti-climbing function.

Correspondingly, the first connecting portion 30 configured to mount the anti-climbing energy-absorbing device on a train is arranged at a second end of the energy-absorbing tube 10, that is, the anti-climbing portion 20 and the first connecting portion 30 are respectively arranged at two opposite ends of the energy-absorbing tube 10. To facilitate the mounting of the first connecting portion 30, the first connecting portion 30 is provided with a first mounting hole. In some embodiments, four corners of the first connecting portion 30 can each be provided with the first mounting hole to improve the stability of the first connecting portion 30 after being mounted on the train.

Figure 3:
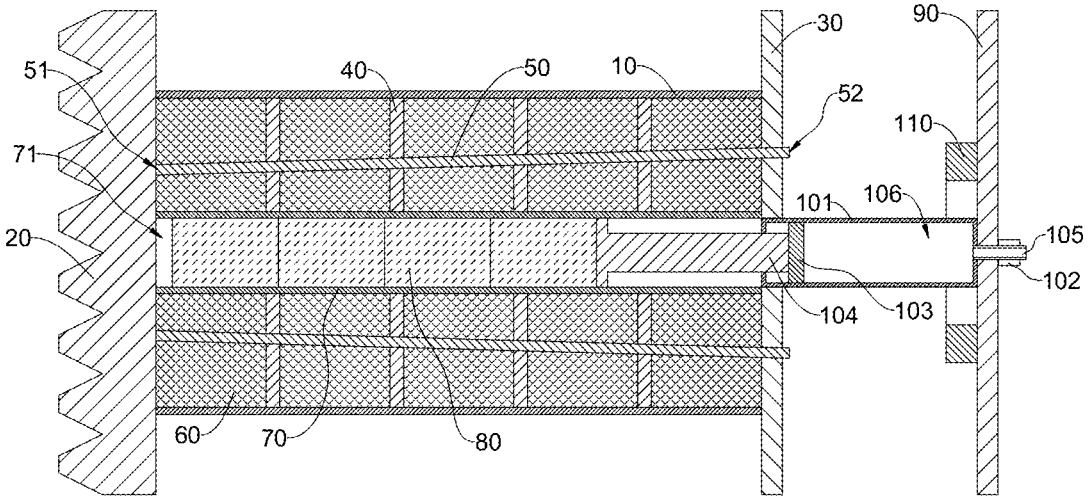
FIG. 3 is a cross-sectional view of the guide-type anti-climbing energy-absorbing device shown in FIG. 1.
Figure 4:
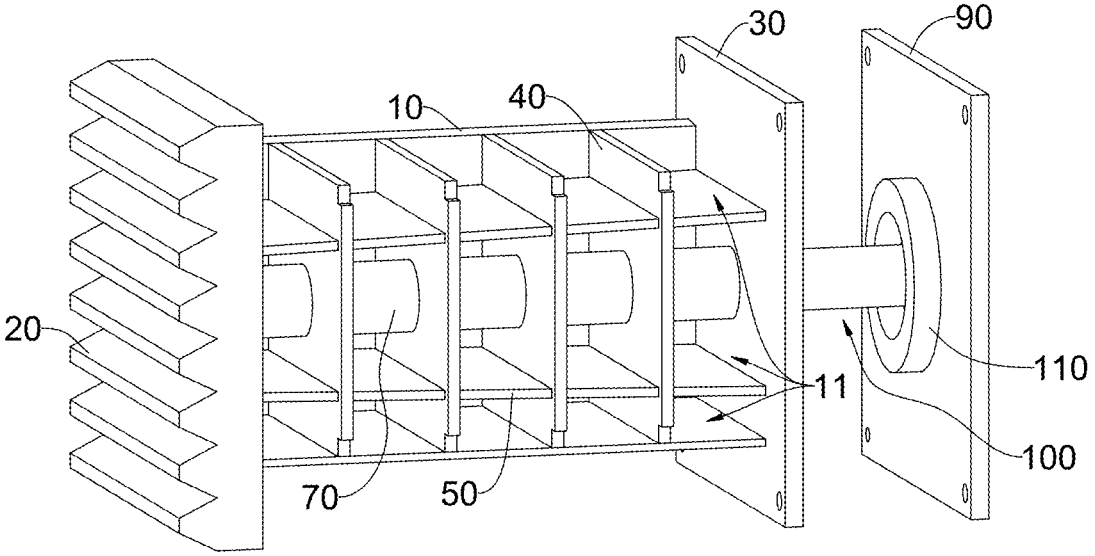
FIG. 4 is a schematic structural diagram of an interior of the guide-type anti-climbing energy-absorbing device shown in FIG. 1 with the first honeycomb bodies removed.

As shown in FIGS. 3-4, the plurality of partition plates 40 are sequentially arranged inside the energy-absorbing tube 10 along an axial direction of the energy-absorbing tube 10 (i.e., the longitudinal impact direction) and are configured to divide an interior of the energy-absorbing tube 10 into a plurality of independent first energy-absorbing cavities 11. The plurality of first energy-absorbing cavities 11 is filled with a first honeycomb body 60. In this embodiment, four partition plates 40 are provided in the energy-absorbing tube 10 to divide the interior of the energy-absorbing tube 10 into five first energy-absorbing cavities 11.

It can be understood that the first honeycomb body 60 can be, but is not limited to, an aluminum honeycomb. In the practical implementation, the axes of holes on the first honeycomb body 60 should be parallel to an axis of the energy-absorbing tube 10, such that in the case of a collision, the first honeycomb body 60 can be smoothly crushed and deformed along the longitudinal impact direction.

It should be noted that, in order to allow the plurality of partition plates 40 to be sequentially arranged and fixed inside the energy-absorbing tube 10, as shown in FIG. 2, in the practical implementation, at least two sides of each of the plurality of partition plates 40 can be each provided with a protrusion 41. In addition, a side wall of the energy-absorbing tube 10 corresponding to at least two sides is provided with a plurality of accommodating grooves 12 in one-to-one correspondence with protrusions 41 on the plurality of partition plates. In this way, when practically mounting the plurality of partition plates 40, it is only required to insert the protrusions 41 on two sides of the partition plates 40 into the plurality of accommodating grooves 12 on the corresponding side wall of the energy-absorbing tube 10, such that the protrusions 41 can be welded and fixed to the corresponding side wall of the energy-absorbing tube 10, thereby achieving reliable fixation of the plurality of partition plates 40.

Moreover, the two guide plates 50 are symmetrically arranged in the energy-absorbing tube 10 along a vertical direction of the energy-absorbing tube 10. Each of the two guide plates 50 is arranged obliquely and has a connecting end 51 and a free end 52 opposite to each other. As shown in FIG. 3, the connecting end 51 is connected to the anti-climbing portion 20, and the free end 52 passes through the plurality of partition plates 40 in sequence to extend outside the first connecting portion 30. Each of the two guide plates 50 is in slidable fit with the first connecting portion 30, so the two guide plates 50 are slidable relative to the first connecting portion 30, respectively. In addition, the connecting end 51 is closer to an axis of the energy-absorbing tube 10 relative to the free end 52, that is, each of the two guide plates 50 is gradually located away from the axis of the energy-absorbing tube 10 along a direction from the anti-climbing portion 20 to the first connecting portion 30.

In practical implementation, the width of each of the two guide plates 50 is equal to the width of an inner cavity of the energy-absorbing tube 10. As shown in FIG. 4, each of the plurality of first energy-absorbing cavities 11 is further divided into an upper sub-cavity, a middle sub-cavity, and a lower sub-cavity through the two guide plates 50. As shown in FIG. 2, the first honeycomb body 60 is further divided into three portions through the two guide plates 50, which are sequentially filled in the upper, middle, and lower sub-cavities. A section of each of the three portions of the first honeycomb body 60 is in a trapezoidal shape.

According to such arrangement, the plurality of partition plates 40 are arranged in the energy-absorbing tube 10 to separate the plurality of first energy-absorbing cavities 11, and the two guide plates 50 are each arranged obliquely. In practical application, once the train collision occurs and the anti-climbing energy-absorbing device is subjected to a longitudinal impact, the anti-climbing portion 20 can stably move toward the first connecting portion 30 along the longitudinal impact direction under the limiting and guiding action of the two guide plates 50. During this process, the first honeycomb body 60 will be crushed and deformed one by one along the direction from the anti-climbing portion 20 to the first connecting portion 30, thus realizing the level-by-level absorption of collision energy.

It should be noted that for the anti-climbing energy-absorbing device provided herein, the plurality of partition plates 40 are arranged inside the energy-absorbing tube 10 to divide the interior of the energy-absorbing tube 10 into multiple first energy-absorbing cavities 11, and the plurality of first energy-absorbing cavities 11 are respectively filled with independent first honeycomb bodies 60 to realize the series combination of the first honeycomb bodies 60, thereby greatly improving the energy absorption capacity. In addition, by means of the two guide plates, the first honeycomb body 60 can be crushed one by one, and the mutual embedding will not occur between the first honeycomb body 60 in different first energy-absorbing cavities 11. It ensures that each first honeycomb body 60 has an excellent energy-absorbing effect and can effectively prevent the simultaneous deformation between the first honeycomb bodies 60 in different first energy-absorbing cavities 11, thereby avoiding the instability and failure of the anti-climbing energy-absorbing device to achieve efficient collision energy absorption.

Moreover, the two guide plates 50 are arranged obliquely and can play a reliable limiting and guiding role, such that the first honeycomb body 60 can undergo orderly and controllable plastic deformation along the longitudinal impact direction. Moreover, the two guide plates can further divide each of the first honeycomb bodies 60 into structures with a trapezoidal cross-section. Cross-sections of portions of the first honeycomb body 60 in a single first energy-absorbing cavity 11 separated by the two guide plates 50 changes sequentially along the longitudinal impact direction, such that the first honeycomb body 60 in each of the plurality of first energy-absorbing cavities 11 can be fully crushed and deformed, thereby maximizing the energy absorption capacity. In addition, the vertical and transverse bearing capacity of the entire anti-climbing energy-absorbing device can be improved to further improve the reliability of the anti-climbing energy-absorbing device when mounted on the train.

In addition, in practical implementation, the first honeycomb bodies 60 filled in the plurality of energy-absorbing cavities 11 are arranged in ascending order in terms of yield strength along the direction from the anti-climbing portion 20 to the first connecting portion 30 (that is, for any two adjacent first honeycomb bodies 60, the yield strength of one of any two adjacent first honeycomb bodies 60 closer to the anti-climbing portion 20 is lower than that of the other of any two adjacent first honeycomb bodies 60). Specifically, the energy absorption capacity of a honeycomb body depends on its yield strength. The greater the yield strength of the honeycomb body, the greater its energy absorption capacity. In this embodiment, the first honeycomb body 60 closest to the anti-climbing portion 20 has the weakest energy absorption capacity, and the first honeycomb body 60 farthest away from the anti-climbing portion 20 has the greatest energy absorption capacity, such that in the case of a collision, the first honeycomb bodies 60 with gradually-increasing energy absorption capacity are adopted to absorb the collision energy, which can lead to a more stable and reliable energy-absorbing process.

On this basis, to further improve the energy absorption capacity of the anti-climbing energy-absorbing device, the anti-climbing energy-absorbing device includes a crushing tube 70.

In this embodiment, as shown in FIGS. 2-4, the crushing tube 70 is arranged inside the energy-absorbing tube 10 and between the two guide plates 50. The axis of the crushing tube 70 coincides with the axis of the energy-absorbing tube 10. It can be understood that the crushing tube 70 can be, but is not limited to, a thin-walled metal circular tube. In this case, the first end of the crushing tube 70 is connected to the anti-climbing portion 20, and the second end of the crushing tube 70 passes through the plurality of partition plates 40 in sequence to be connected to the first connecting portion 30. Moreover, a second energy-absorbing cavity 71 is provided inside the crushing tube 70 and is filled with a second honeycomb body 80.

It can be understood that the crushing tube 70 passes through the plurality of partition plates 40 and is in slidable fit with a single partition plate 40, such that the crushing tube 70 can slide relative to the plurality of partition plates 40, thereby allowing the crushing tube 70 to be smoothly crushed and deformed along the longitudinal impact direction. Meanwhile, the second honeycomb body 80 can be but is not limited to, an aluminum honeycomb. In the practical implementation, the axes of holes on the second honeycomb body 80 should be parallel to the axis of the energy-absorbing tube 10 such that in the case of a collision, the second honeycomb body 80 can be smoothly crushed and deformed along the longitudinal impact direction.

According to such an arrangement, in the case of a collision, in addition to the energy-absorbing tube 10 as well as the first honeycomb bodies 60, the crushing tube 70 and the second honeycomb body 80 can also be crushed and deformed to absorb the collision energy, thereby improving the energy absorption capacity of the entire anti-climbing energy-absorbing device. Moreover, the crushing tube 70 is arranged inside the energy-absorbing tube 10, thereby further improving the vertical and transverse bearing capacity of the anti-climbing energy-absorbing device before the collision has occurred.

It can be understood that, as shown in FIG. 3, the second honeycomb body 80 can be arranged in plurality in practical implementation. Moreover, a plurality of second honeycomb bodies 80 are sequentially stacked along an axial direction of the crushing tube 70. In this embodiment, four second honeycomb bodies 80 are filled in the second energy-absorbing cavity 71. In this case, a gap is provided between one of the plurality of second honeycomb bodies 80 proximate to the anti-climbing portion 20 and the anti-climbing portion 20, such that only when the energy-absorbing tube 10 close to the anti-climbing portion 20 and the corresponding first honeycomb body 60 are crushed and deformed to a certain extent, the second honeycomb body 80 proximate to the anti-climbing portion 20 begins to collapse and deform, thereby improving the reliability of collision energy absorption.

Secondly, the plurality of second honeycomb body 80 is arranged in ascending order in terms of yield strength along the direction from the anti-climbing portion 20 to the first connecting portion 30 (that is, for any two adjacent second honeycomb body 80, the yield strength of one of any two adjacent first honeycomb body 80 closer to the anti-climbing portion 20 is lower than that of the other of any two adjacent second honeycomb body 80), such that the energy absorption capacity of the plurality of second honeycomb body 80 increases sequentially along the longitudinal impact direction, which can lead to a more stable and reliable energy absorption process.

On the other hand, to allow the anti-climbing energy-absorbing device to have a hybrid energy-absorbing capability, the anti-climbing energy-absorbing device further includes a second connecting portion 90 and a hydraulic energy-absorbing assembly 100. As shown in FIGS. 1-4, the second connecting portion 90 is arranged opposite to the first connecting portion 30 and is provided with a second mounting hole to facilitate the mounting of the second connecting portion 90 on the train. In some embodiments, four corners of the second connecting portion 90 can be each provided with a second mounting hole to improve the stability of the second connecting portion 90 after being mounted on the train. In addition, the first connecting portion 30 is located between the anti-climbing portion 20 and the second connecting portion 90, and the hydraulic energy-absorbing assembly 100 is arranged between the first connecting portion 30 and the second connecting portion 90.

Specifically, as shown in FIG. 3, the hydraulic energy-absorbing assembly 100 includes a cylinder 101, a solenoid valve 102, a piston 103, and a piston rod 104. A first end of the cylinder 101 is connected to the second connecting portion 90, and a second end of the cylinder 101 faces toward the first connecting portion 30. In some embodiments, the outer diameter of cylinder 101 is equal to the inner diameter of the crushing tube 70, and the second end of cylinder 101 passes through the first connecting portion 30 to extend into crushing tube 70. In addition, cylinder 101 is slidable and fits with the crushing tube 70, so that cylinder 101 can slide relative to the crushing tube 70.

Secondly, the first end of the cylinder 101 is provided with an oil outlet 105. The solenoid valve 102 is arranged at the oil outlet 105 to control the opening or closing of the oil outlet 105. The piston 103 is arranged inside the cylinder 101. A sealing cavity 106 filled with hydraulic oil is provided between the piston 103 and the oil outlet 105. It is communicated with the oil outlet 105. The first end of the piston rod 104 is connected to a side of the piston 103 away from the oil outlet 105. The second end of the piston rod 104 passes through cylinder 101 to extend into the crushing tube 70 and is in contact with the second honeycomb body 80. In some embodiments, the outer diameter of the second end of the piston rod 104 is equal to the inner diameter of the crushing tube 70, such that the piston rod 104 can be fully in contact with the end surface of the second honeycomb body 80.

Based on such an arrangement, a pressure threshold for opening the solenoid valve 102 can be preset first in practical application. Once a collision occurs and the second honeycomb body 80 begins to collapse and deform, the second honeycomb body 80 will transmit an extrusion force to the piston rod 104. Meanwhile, the extrusion force acting on the piston rod 104 is transmitted to the piston 103, such that the hydraulic oil in the sealing cavity 106 is squeezed by the piston 103. As the second honeycomb body 80 is continuously crushed and deformed, a squeezing force acting on the piston rod 104 will gradually increase. Meanwhile, the pressure of the hydraulic oil in the sealing cavity 106 will continuously increase. When the pressure of the hydraulic oil in the sealing cavity 106 reaches the preset pressure threshold of the solenoid valve 102 at a certain moment, the solenoid valve 102 is opened, and the hydraulic oil in the sealing cavity 106 will flow out from the oil outlet 105. During this process, due to the viscous damping characteristic of the hydraulic oil in the sealing cavity 106, the collision energy will be partially converted into the pressure and heat energy of the hydraulic oil along with the flow of the hydraulic oil, thereby utilizing the hydraulic energy-absorbing assembly 100 to absorb the collision energy.

In addition, referring to FIGS. 1-3, in practical implementation, a buffer block 110 can be provided at the side of the second connecting portion 90 facing toward the first connecting portion 30. The buffer block 110 can be but is not limited to, made of rubber. Moreover, the buffer block 110 is substantially in an annular shape and arranged around cylinder 101. By means of the buffer block 110, when a crushing energy-absorbing structure composed of the energy-absorbing tube 10 fails and the first connecting portion 30 moves toward the second connecting portion 90 to abut the second connecting portion 90, the buffer block 110 can provide an excellent buffering effect.

In order to make the anti-climbing energy-absorbing device provided herein clearer and more intuitive, an operating principle of the anti-climbing energy-absorbing device will be further explained below based on a specific application scenario.

Figure 5:
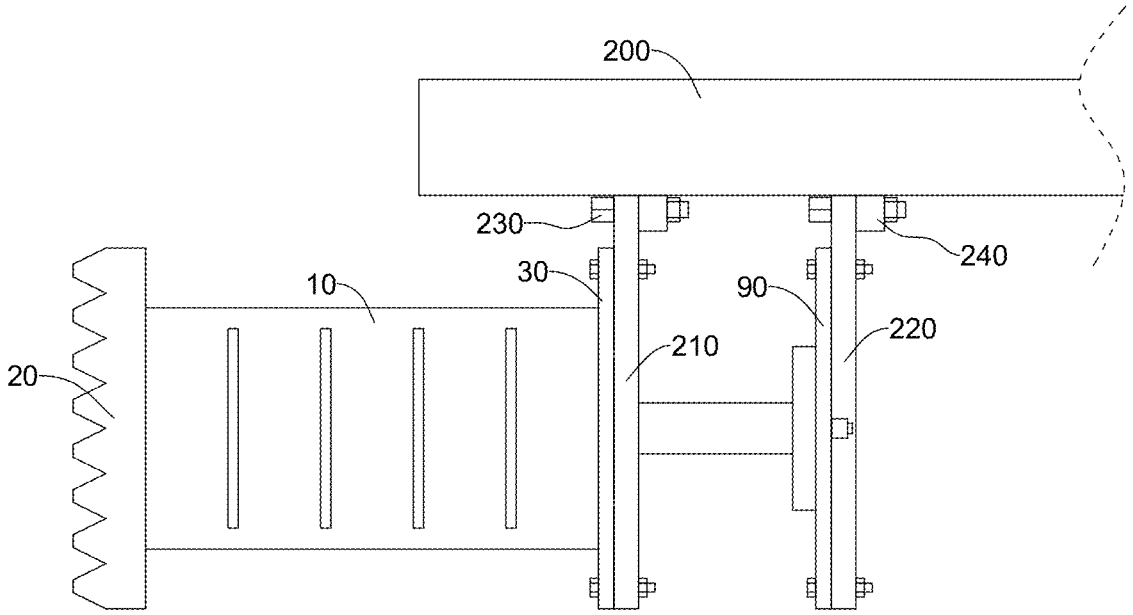
FIG. 5 is a schematic structural diagram of the guide-type anti-climbing energy-absorbing device shown in FIG. 1 after being mounted on a train chassis.

In practical application, the anti-climbing energy-absorbing device is first mounted on a train chassis 200 at the end of a train. Specifically, as shown in FIG. 5, a first mounting base 210 and a second mounting base 220 are sequentially provided on the train chassis 200 along the longitudinal impact direction. The first mounting base 210 is fixed on the train chassis 200 through a shear bolt 230. The second mounting base 220 is fixed on the train chassis 200 through a conventional fastening bolt 240. Then, a fastener such as a bolt is used to fix the first connecting portion 30 on the first mounting base 210 through the first mounting hole. Correspondingly, a fastener such as a bolt is used to fix the second connecting portion 90 on the second mounting base 220 through the second mounting hole. In addition, a side of the anti-climbing portion 20 with the anti-climbing teeth faces toward the outside of the end of the train.

When a collision occurs between two trains, each anti-climbing portion 20 on the two trains enables them to engage with each other through the anti-climbing teeth, thereby realizing the anti-climbing function. Subsequently, the anti-climbing energy-absorbing device begins to perform level-by-level absorb energy absorption.

Specifically, for the anti-climbing energy-absorbing device of a single train, a longitudinal impact force generated during the collision acts on the anti-climbing portion 20 to drive the anti-climbing portion 20 to move toward the first connecting portion 30. At this time, the energy-absorbing tube 10, the crushing tube 70, and the plurality of first energy-absorbing cavities 11 begin to gradually crush and deform one by one along the longitudinal impact direction, thereby realizing the collision energy absorption.

After the anti-climbing portion 20 is in contact with the second honeycomb body 80 proximate to the anti-climbing portion 20 during movement of the anti-climbing portion 20 toward the first connecting portion 30, the plurality of second honeycomb bodies 80 will also begin to collapse and deform level by level, thereby further realizing the collision energy absorption. During this process, the second honeycomb body 80 in contact with the piston rod 104 will transmit the extrusion force to the piston rod 104, such that the piston rod 104 is driven to squeeze the piston 103 toward the oil outlet 105. Meanwhile, the pressure of the hydraulic oil in the sealing cavity 106 continuously increases. When the pressure of the hydraulic oil in the sealing cavity 106 reaches the preset pressure threshold of the solenoid valve 102, the solenoid valve 102 is opened, and the hydraulic oil in the sealing cavity 106 will begin to flow out from the oil outlet 105. During this process, the collision energy will be partially converted into the pressure and heat energy of the hydraulic oil, thereby realizing the collision energy absorption by means of the hydraulic energy-absorbing assembly 100.

As the collision proceeds, when the longitudinal impact force generated by the collision is greater than the shear force of the shear bolt 230 configured to connect the first mounting base 210 to the train chassis 200, the shear bolt 230 will break. Thereafter, the first connecting portion 30 will be driven by the first mounting base 210 to move toward the second connecting portion 90 under the longitudinal impact force. During this process, cylinder 101 slides inside the crushing tube 70 relative to the crushing tube 70, and the piston 103 is continuously squeezed by the piston rod 104, such that the hydraulic oil in the sealing cavity 106 is continuously pressurized and flows out from the oil outlet 105 to effectively absorb the collision energy until the first connecting portion 30 moves to abut the buffer block 110. The buffer block 110 can provide an excellent buffering effect.

In summary, for the anti-climbing energy-absorbing device, the plurality of partition plates 40 are sequentially arranged inside the energy-absorbing tube 10 along the longitudinal impact direction to divide the interior of the energy-absorbing tube 10 into multiple first energy-absorbing cavities 11, and the first energy-absorbing cavities 11 are respectively filled with first honeycomb bodies 60 whose yield strengths are ascending to realize the series combination of the first honeycomb bodies 60, thereby greatly improving the energy absorption capacity. In addition, during the energy absorption process, the first honeycomb bodies 60 can be crushed and deformed independently, which can effectively prevent the mutual embedding between first honeycomb bodies 60 in different first energy-absorbing cavities 11 or simultaneous deformation resulting in a poor energy absorption effect to make the crushing and deformation process of the first honeycomb bodies 60 more stable and orderly.

Secondly, on the one hand, the two guide plates 50 are arranged obliquely inside the energy-absorbing tube 10 and can play an excellent limiting and guiding role, such that the first honeycomb bodies 60 can undergo an orderly and controllable plastic deformation along the longitudinal impact direction. Moreover, the two guide plates 50 can further divide each of the first honeycomb bodies 60 into structures with a trapezoidal cross-section, such that the first honeycomb body 60 in each of the plurality of first energy-absorbing cavities 11 can be fully crushed and deformed, thereby maximizing the energy absorption capacity of each first honeycomb body 60. On the other hand, by means of the two guide plates 50, the vertical and transverse bearing capacity of the anti-climbing energy-absorbing device can be effectively improved to further improve the reliability of the anti-climbing energy-absorbing device when mounted on the train.

In addition, the crushing tube 70, filled with the plurality of the second honeycomb body 80, is arranged inside the energy-absorbing tube 10, which can cooperate with the first honeycomb body 60 to jointly absorb the collision energy. On this basis, the hydraulic energy-absorbing assembly 100 can utilize the viscous damping characteristic of the hydraulic oil to convert the collision energy into the pressure and heat energy of the hydraulic oil, such that the anti-climbing energy-absorbing device has a hybrid energy-absorbing capability to further improve the energy-absorbing capacity of the anti-climbing energy-absorbing device. In practical application, in the case of the failure of the crushing energy-absorbing structure composed of the energy-absorbing tube 10, the anti-climbing energy-absorbing device can continuously absorb the collision energy by means of the hydraulic energy-absorbing assembly 100, thereby avoiding the failure of the entire anti-climbing energy-absorbing device to further improve the reliability of the anti-climbing energy-absorbing device in practical applications.

The embodiments described above are merely illustrative of the present application and are not intended to limit the scope of the present application. Various modifications, replacements, and improvements made by those of ordinary skill in the art without departing from the spirit of this application shall fall within the scope of the disclosure defined by the appended claims.

What is claimed is:

1. A guide-type anti-climbing energy-absorbing device based on hydraulic shearing, comprising:

an energy-absorbing tube;

an anti-climbing portion;

a first connecting portion;

a plurality of partition plates; and two guide plates;

wherein the anti-climbing portion is arranged at a first end of the energy-absorbing tube, and the first connecting portion is arranged at a second end of the energy-absorbing tube;

the plurality of partition plates are sequentially arranged inside the energy-absorbing tube along an axial direction of the energy-absorbing tube and are configured to divide an interior of the energy-absorbing tube into a plurality of first energy-absorbing cavities; and the plurality of first energy-absorbing cavities are each filled with a first honeycomb body;

the two guide plates are symmetrically arranged in the energy-absorbing tube along a vertical direction of the energy-absorbing tube; and each of the two guide plates is arranged obliquely and has a connecting end and a free end opposite to each other; the connecting end is connected to the anti-climbing portion; the free end passes through the plurality of partition plates in sequence to extend outside the first connecting portion; each of the two guide plates is in slidable fit with the first connecting portion; and the connecting end is closer to an axis of the energy-absorbing tube relative to the free end; and wherein first honeycomb bodies filled in the plurality of energy-absorbing cavities are arranged in an ascending order in terms of yield strength along a direction from the anti-climbing portion to the first connecting portion.

2. The guide-type anti-climbing energy-absorbing device of claim 1, wherein at least two sides of each of the plurality of partition plates are each provided with a protrusion and a side wall of the energy-absorbing tube is provided with a plurality of accommodating grooves in one-to-one correspondence with protrusions on the plurality of partition plates.

3. A guide-type anti-climbing energy-absorbing device based on hydraulic shearing, comprising:

an energy-absorbing tube;

an anti-climbing portion;

a first connecting portion;

a plurality of partition plates;

two guide plates; and a crushing tube;

wherein the anti-climbing portion is arranged at a first end of the energy-absorbing tube, and the first connecting portion is arranged at a second end of the energy-absorbing tube;

the plurality of partition plates are sequentially arranged inside the energy-absorbing tube along an axial direction of the energy-absorbing tube and are configured to divide an interior of the energy-absorbing tube into a plurality of first energy-absorbing cavities; and the plurality of first energy-absorbing cavities are each filled with a first honeycomb body;

the two guide plates are symmetrically arranged in the energy-absorbing tube along a vertical direction of the energy-absorbing tube; and each of the two guide plates is arranged obliquely and has a connecting end and a free end opposite to each other; the connecting end is connected to the anti-climbing portion; the free end passes through the plurality of partition plates in sequence to extend outside the first connecting portion; each of the two guide plates is in slidable fit with the first connecting portion; and the connecting end is closer to an axis of the energy-absorbing tube relative to the free end; and wherein the crushing tube is arranged inside the energy-absorbing tube and between the two guide plates; and an axis of the crushing tube is coincident with the axis of the energy-absorbing tube; and a first end of the crushing tube is connected to the anti-climbing portion; a second end of the crushing tube passes through the plurality of partition plates in sequence to be connected to the first connecting portion; and a second energy-absorbing cavity is provided inside the crushing tube, and is filled with a second honeycomb body.

4. The guide-type anti-climbing energy-absorbing device of claim 3, further comprising:

a second connecting portion; and a hydraulic energy-absorbing assembly;

wherein the second connecting portion is arranged opposite to the first connecting portion; and the hydraulic energy-absorbing assembly is arranged between the first connecting portion and the second connecting portion;

the hydraulic energy-absorbing assembly comprises a cylinder, a solenoid valve, a piston, and a piston rod; a first end of the cylinder is connected to the second connecting portion; and a second end of the cylinder faces toward the first connecting portion;

the first end of the cylinder is provided with an oil outlet; and the solenoid valve is arranged at the oil outlet and is configured to control opening or closing of the oil outlet;

the piston is arranged inside the cylinder; a sealing cavity is provided between the piston and the oil outlet; and the sealing cavity is filled with hydraulic oil and is communicated with the oil outlet; and a first end of the piston rod is connected to a side of the piston away from the oil outlet; and a second end of the piston rod passes through the cylinder to extend into the crushing tube and is in contact with the second honeycomb body.

5. The guide-type anti-climbing energy-absorbing device of claim 4, wherein an outer diameter of the cylinder is equal to an inner diameter of the crushing tube; and the second end of the cylinder passes through the first connecting portion extends into the crushing tube; and a buffer block is provided at a side of the second connecting portion facing toward the first connecting portion; and the buffer block is arranged around the cylinder.

6. The guide-type anti-climbing energy-absorbing device of claim 4, wherein the first connecting portion is provided with a first mounting hole, and the second connecting portion is provided with a second mounting hole.

7. The guide-type anti-climbing energy-absorbing device of claim 3, wherein the second honeycomb body is arranged in plurality, and a plurality of second honeycomb bodies are sequentially stacked along an axial direction of the crushing tube; and a gap is provided between one of the plurality of second honeycomb bodies close to the anti-climbing portion and the anti-climbing portion.

8. The guide-type anti-climbing energy-absorbing device of claim 7, wherein the plurality of second honeycomb bodies are arranged in an ascending order in terms of yield strength along a direction from the anti-climbing portion to the first connecting portion.

* * * * *